US007748413B2

(12) United States Patent
Kojima

(10) Patent No.: US 7,748,413 B2
(45) Date of Patent: Jul. 6, 2010

(54) COLLAPSIBLE LOOM

(76) Inventor: Hiroyoshi Kojima, Rullatie 7, FI-17300 Vääksy (FI)

( * ) Notice: Subject to any disclaimer, the term of this patent is extended or adjusted under 35 U.S.C. 154(b) by 0 days.

(21) Appl. No.: 12/289,883

(22) Filed: Nov. 7, 2008

(65) Prior Publication Data

US 2009/0126822 A1 May 21, 2009

(30) Foreign Application Priority Data

Nov. 7, 2007 (FI) ..... 20070839

(51) Int. Cl.
*D03D 29/00* (2006.01)
*D03D 41/00* (2006.01)

(52) U.S. Cl. ..... 139/21; 139/31; 139/30; 139/32; 139/33; 139/34

(58) Field of Classification Search ..... 139/29, 139/30, 31, 32, 33, 33.5, 34
See application file for complete search history.

(56) References Cited

U.S. PATENT DOCUMENTS

| | | | | | |
|---|---|---|---|---|---|
| 1,904,715 | A | * | 4/1933 | Bergman et al. | 139/29 |
| 2,077,532 | A | * | 4/1937 | Rossiter | 139/33 |
| 2,094,505 | A | * | 9/1937 | Thackeray | 139/33 |
| 2,096,659 | A | * | 10/1937 | Webster et al. | 139/33 |
| 2,098,449 | A | * | 11/1937 | Churchill | 139/29 |
| 2,139,879 | A | * | 12/1938 | Clark et al. | 139/33 |
| 2,146,991 | A | * | 2/1939 | Rowntree et al. | 139/91 |
| 2,150,187 | A | * | 3/1939 | Raba et al. | 139/33 |
| 2,190,813 | A | * | 2/1940 | Walker | 28/151 |
| 2,209,597 | A | * | 7/1940 | Clark et al. | 139/33 |
| 2,241,318 | A | * | 5/1941 | Robson | 139/33 |
| 2,253,329 | A | * | 8/1941 | Gallinger | 139/33 |
| 2,502,691 | A | * | 4/1950 | Allan et al. | 139/33 |
| 2,544,526 | A | * | 3/1951 | Craymer | 139/18 |
| 2,582,008 | A | * | 1/1952 | Clack | 139/33 |
| 2,640,505 | A | * | 6/1953 | Klaesson | 139/29 |
| 2,691,203 | A | * | 10/1954 | Wilder | 28/149 |
| 2,696,838 | A | * | 12/1954 | Purrington | 139/29 |
| 2,920,657 | A | * | 1/1960 | Schraegle | 139/30 |
| 2,944,569 | A | * | 7/1960 | Schraegle | 139/33 |
| 3,724,041 | A | * | 4/1973 | Cleverley | 28/149 |
| 3,774,649 | A | * | 11/1973 | Glessner | 139/33 |
| 3,996,969 | A | * | 12/1976 | McCullough et al. | 139/29 |
| 4,154,267 | A | | 5/1979 | Orr et al. | |
| 2008/0173368 | A1 | * | 7/2008 | Flodin et al. | 139/33 |

FOREIGN PATENT DOCUMENTS

JP 2003-89947 3/2003

* cited by examiner

*Primary Examiner*—Bobby H Muromoto, Jr.
(74) *Attorney, Agent, or Firm*—Dennison, Schultz & MacDonald

(57) ABSTRACT

A collapsible loom, comprising a folding loom, a removable weaving assembly, including a warp beam (26) with its warps, harness shafts (38), a reed (52), and a cloth beam (19) with its cloth, wherein the removable weaving assembly, which is detachable and transferable to another loom, further includes bars (30) confined in a bar cassette (31), transfer bars (37), tying members (32) for treadles (15), and a number of harness shafts (38) actuated by the treadles (15).

6 Claims, 15 Drawing Sheets

COLLAPSIBLE LOOM

The invention relates to a loom, which can be collapsed in the middle of a weaving operation without disassembling the weaving assembly (a warp H beam 26 with its warps, bars 30, harness shafts 38, transfer bars 37, treadle tying means 32, a reed 52, and a cloth beam 19 with its cloth) and/or without disassembling the loom, and which can be placed in storage as well. When the weaving work continues, the collapsed loom is brought out and erected, the weaving assembly being set up as well and tightened to a weaving condition.

In the invention, harnessing and tying of cords can be performed in another location, for example by a skilled artisan. A completed weaving assembly is transferred/delivered to another loom. This allows even a beginner to start weaving immediately, without a difficult warping process of the beams.

In the invention, the weaver is able to remove his/her own weaving project. The next weaver brings along his/her weaving work and continues weaving his/her unfinished cloth.

With prior known looms, having unfinished work thereon, there is no chance for another person to use the loom while the weaver is away on vacation or the like. Heretofore, it has been impossible to remove an unfinished (not completed) weaving project.

It is an object of this invention to eliminate some of the foregoing drawbacks. A loom according to the invention is characterized in that the removable weaving assembly, which is detachable and transferable to another loom, further includes bars (30) confined in a bar cassette (31), transfer bars (37), tying members (32) for treadles (15), and a number of harness shafts (38) actuated by the treadles (15).

In a preferred embodiment the support for a breast beam and a back beam is provided as close to the warps as possible and horizontally between side beams. A support 3 is turned upright as the loom is collapsed.

The loom of this invention is very easily collapsible. At the same time, it has a type of structure which does not lose its stability even as a result of repeated folding and unfolding.

This invention involves the use of a motor-driven mechanical device 42 for performing the collapsing and erecting work. The device has its worm gear retaining the loom in a collapsed condition. This facilitates folding and unfolding without having to apply a specific force.

This invention provides for a transfer of the unfinished weaving project into a storage/transport case 47 as follows: First, the case 47 is lifted in an opened condition on top of the support beams 3. Then, the warp is loosened. This is followed by making a package of the transfer bars 37 and the tying strips 32 with their cords, which package is placed on the bottom of the case and covered with a middle cloth 49. Next, a bar cassette 31 is picked up from a frame 5, the harness shafts 38 rising at the same time. The harnesses are transferred into the case and covered with the middle cloth 49. On top of the cloth is laid the bar cassette 31 and the middle cloth 49. This is followed by opening a top slay beam 53, thus lifting up a reed 52 with its warps and placing it in the case 47, the shuttle being also placed in the case at the same time. These are covered with the middle cloth 49. This is followed by disengaging the beams from the loom, at same time releasing the beam gears which are retained in the loom. The warps are wound loosely on a warp beam 26, which is lifted into the case. Likewise, a cloth beam 19 and a gear are disengaged and the cloth is wound on the cloth beam, which is lifted into the case and laid alongside the warp beam and a cover 51 is closed.

In this invention, an unfinished weaving project as described above can be put aside and another unfinished weaving project can be placed in the loom and the weaving can be picked up where it was left off. Warps of varying lengths and varying types can be placed at any time without having to wait for the preceding weaver to finish his/her work.

In this invention, the treadles 15 and the transfer bars 37 are present in the form of readily removable cassettes. These can accommodate a necessary number of treadles 15 and transfer bars 37, depending on the size and pattern of a cloth.

The loom is always in useful operation as every weaver is able to put in his/her own cloth (weaving assembly) in turn. A more efficient use of the premises is also obtained as the loom can be collapsed and set aside.

The invention will now be described more closely with reference to the accompanying drawings, in which FIG. 1 shows a side view of the loom in a working condition.

REFERENCE NUMERALS FOR LOOM ELEMENTS

Figure 1:
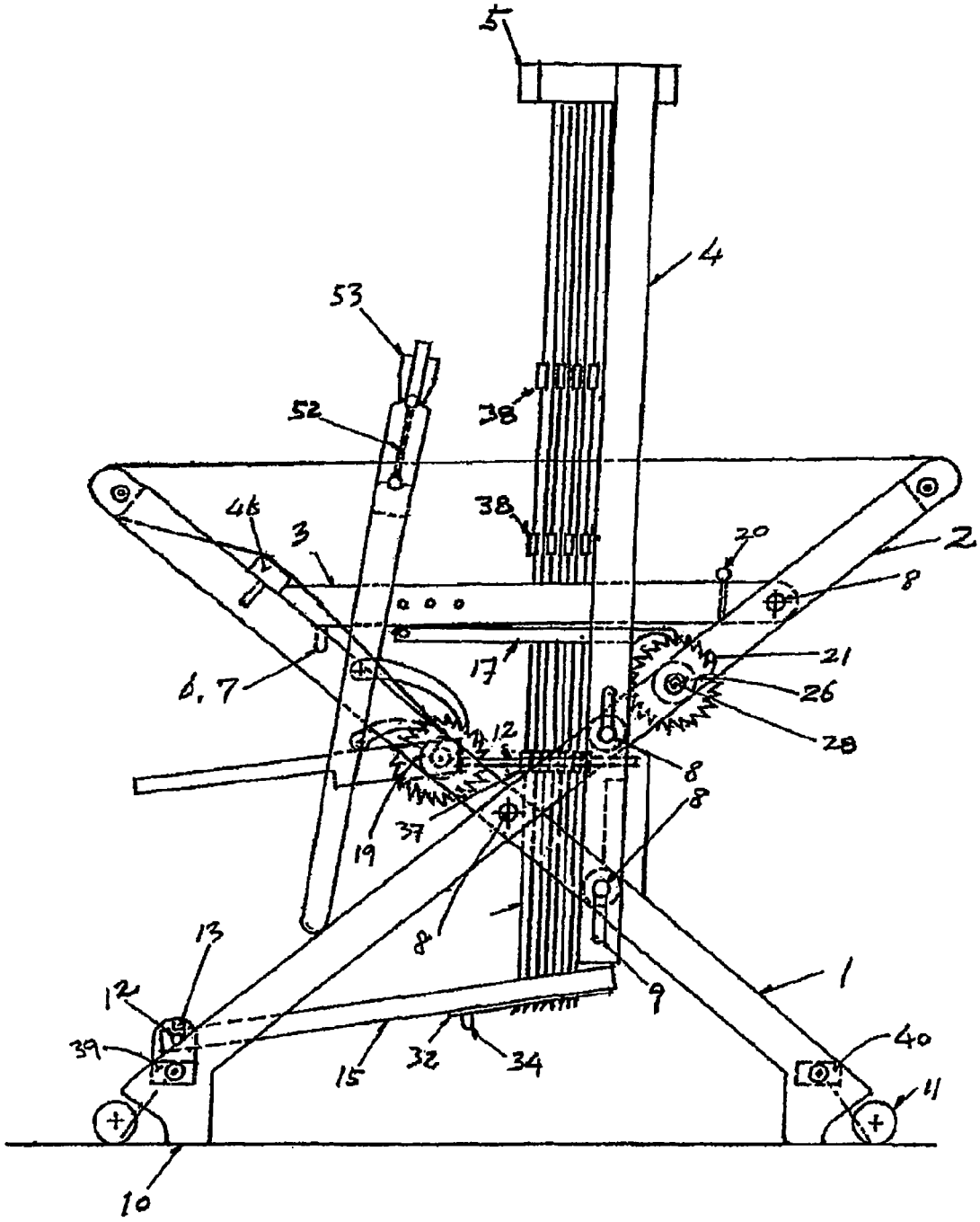
Figure 2:
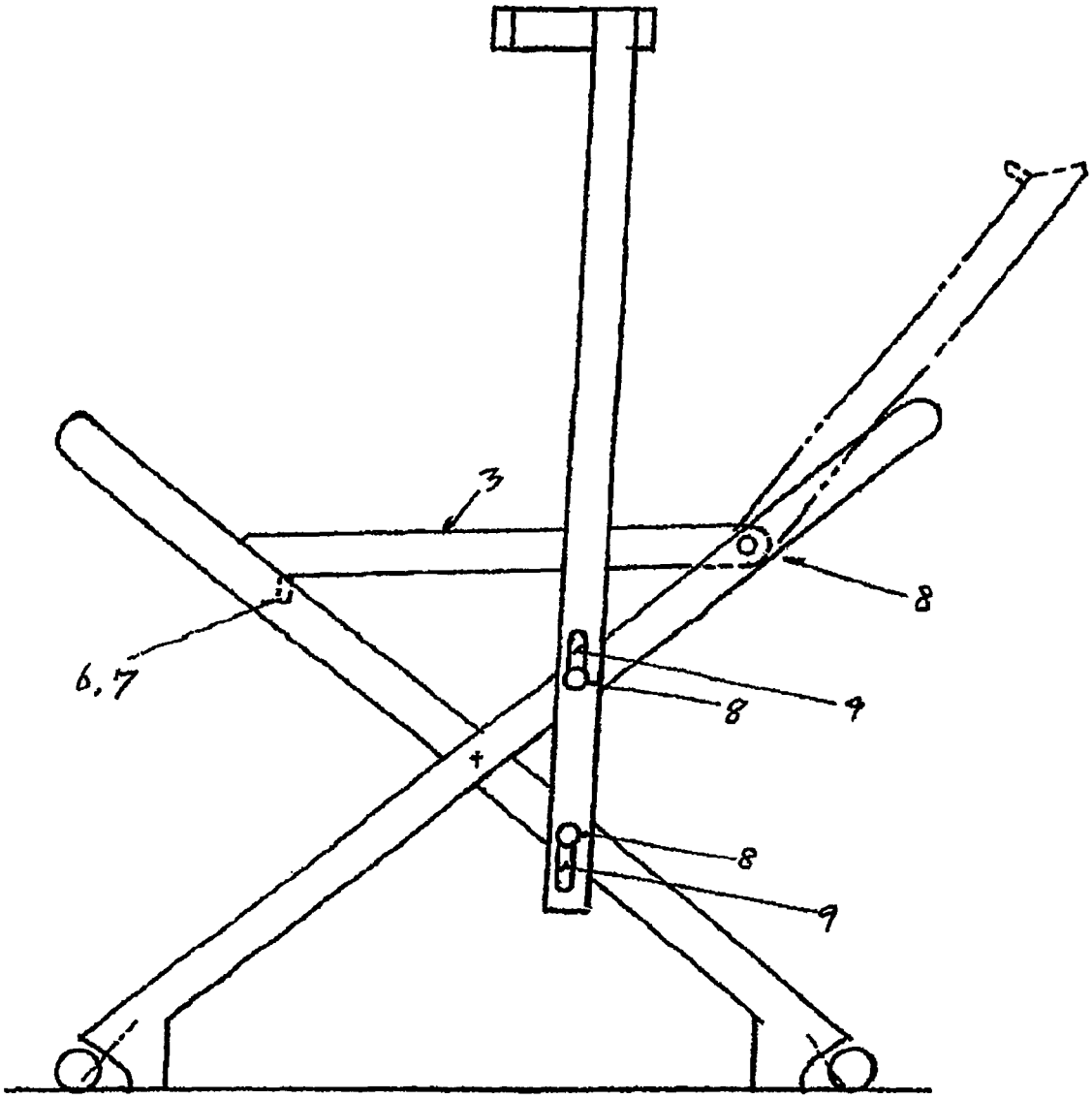
FIG. 2 shows a first step in collapsing the loom by releasing the horizontal beams 3.
Figure 3:
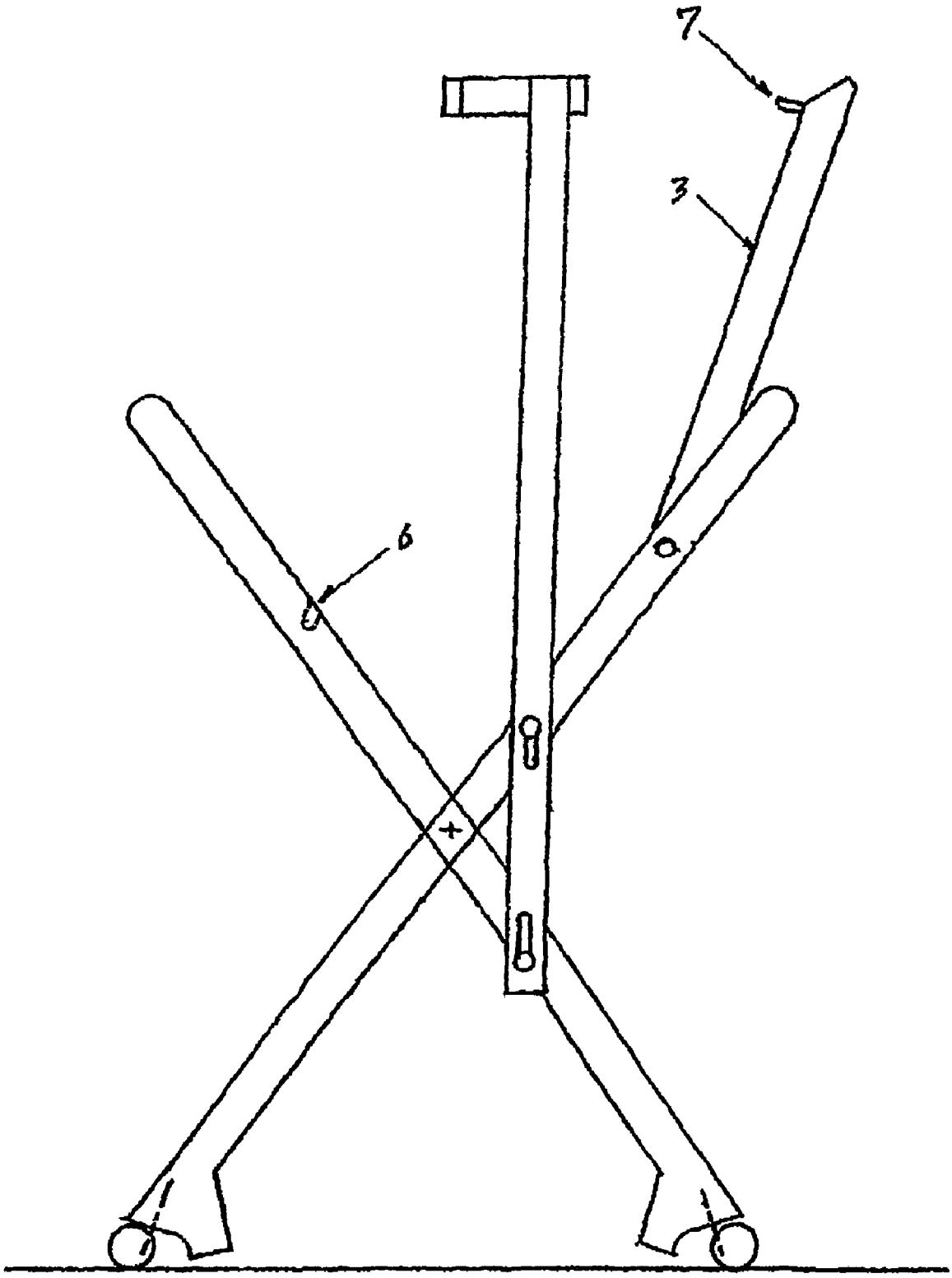
FIG. 3 shows an intermediate step in collapsing the loom.
Figure 4:
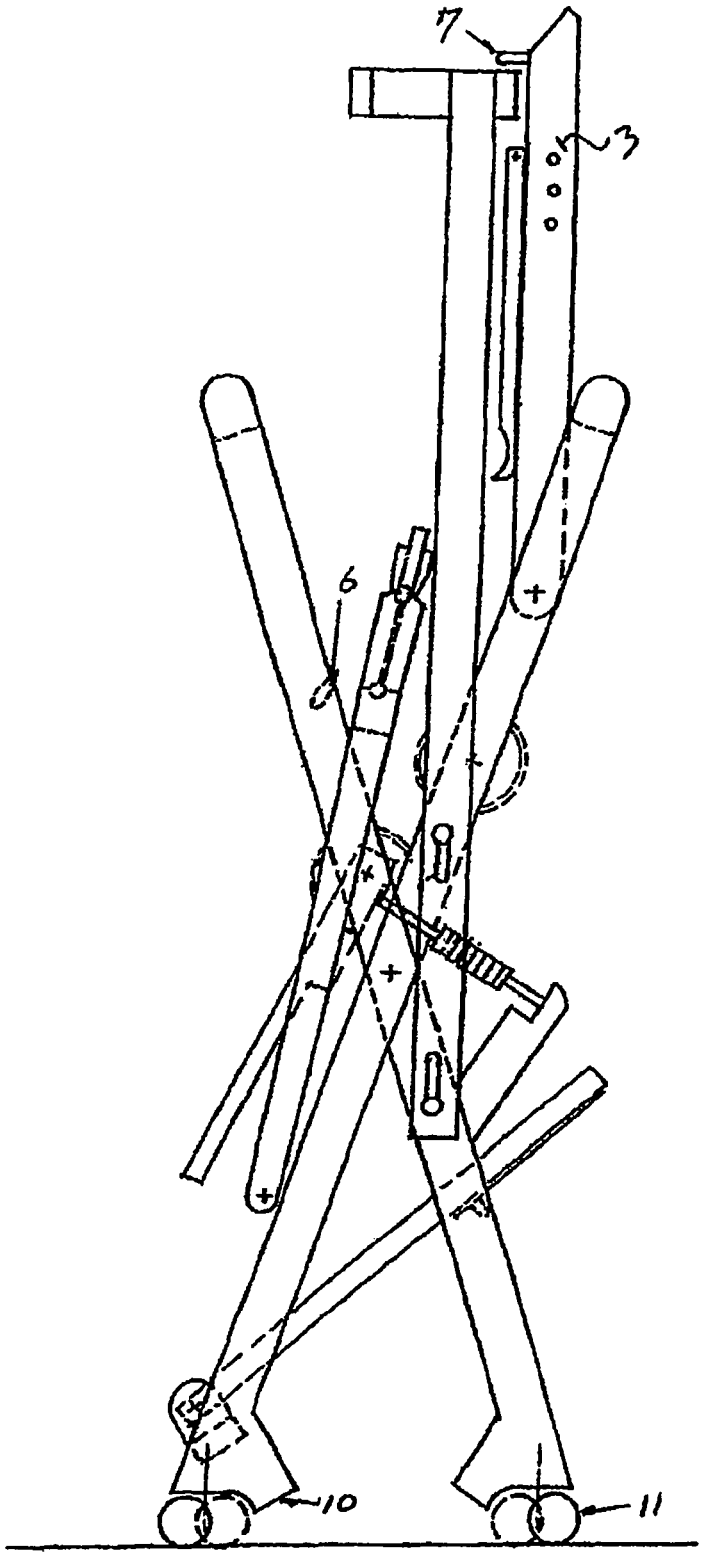
FIG. 4 shows the loom in a collapsed condition.
Figure 5:
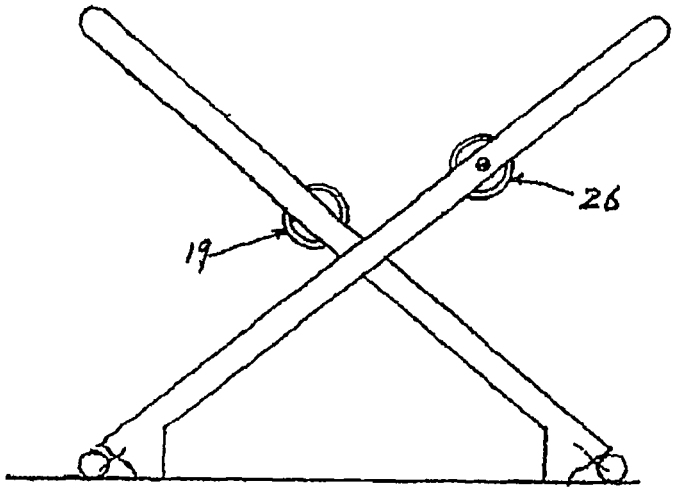
FIG. 5 shows how the cloth beam 19 and the warp beam 26 are set aside.
Figure 6:
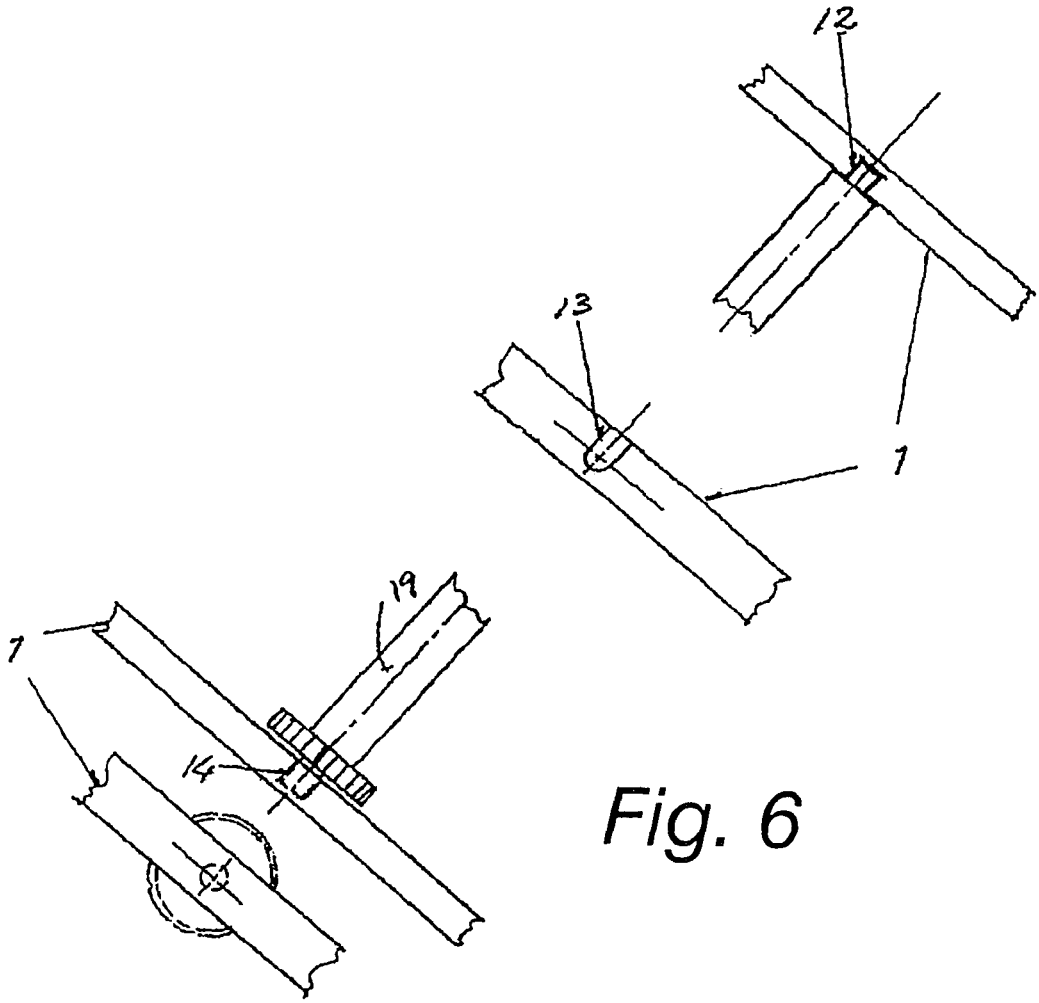
FIG. 6 shows a disengagement of the cloth beam 19, first from a notch then from a hole.
Figure 7:
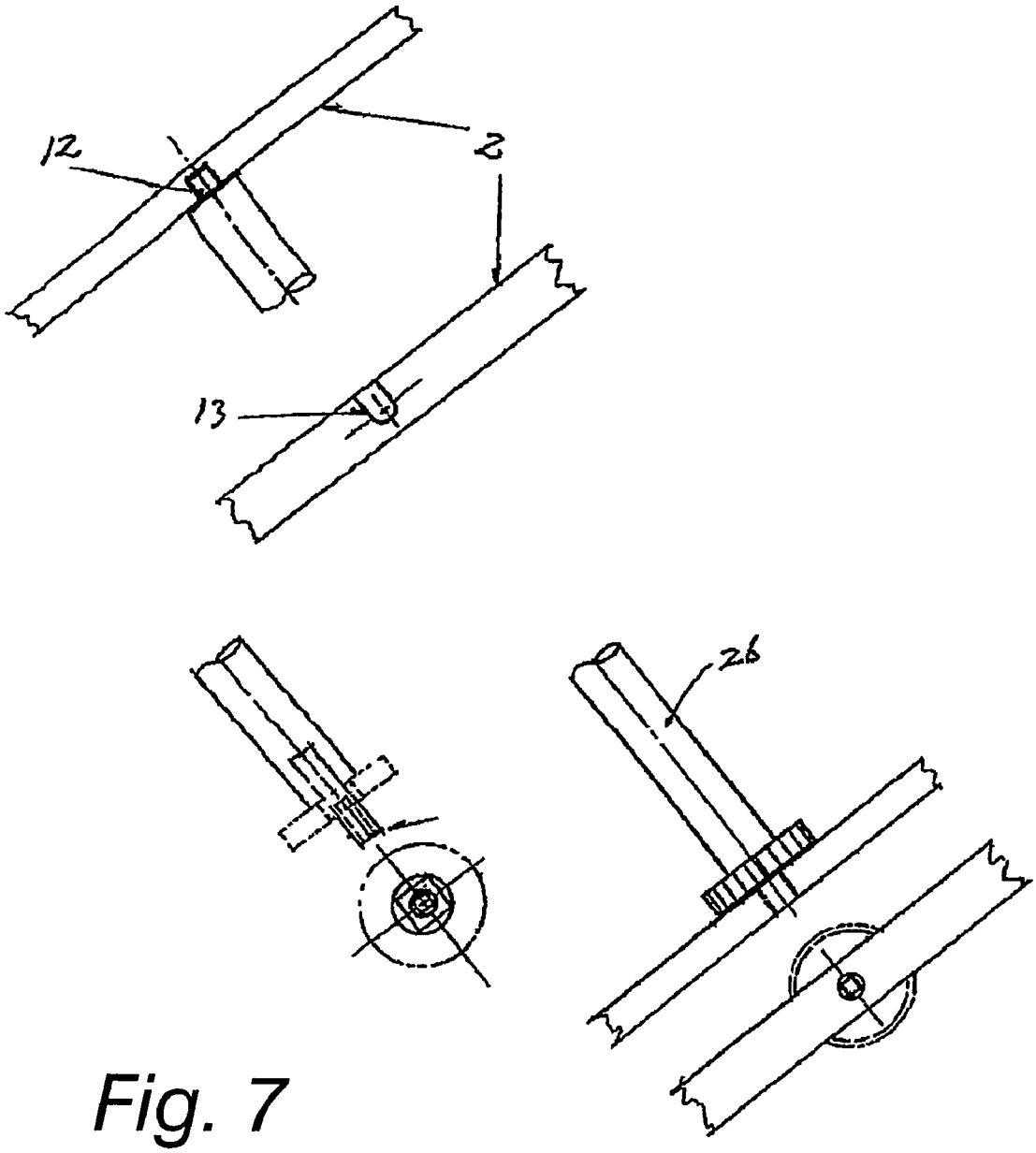
FIG. 7 shows a disengagement of the warp beam 26 just like the cloth beam.
Figure 8:
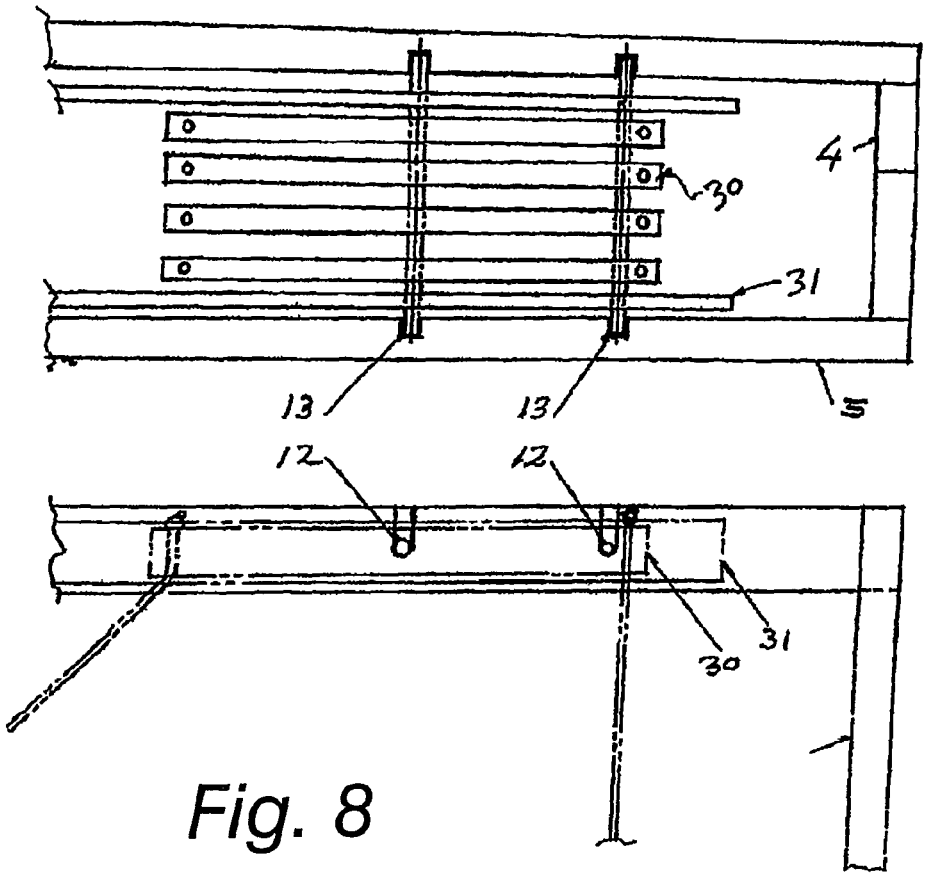
FIG. 8 shows bars 30 and a frame 5 for a set of bars.
Figure 9:
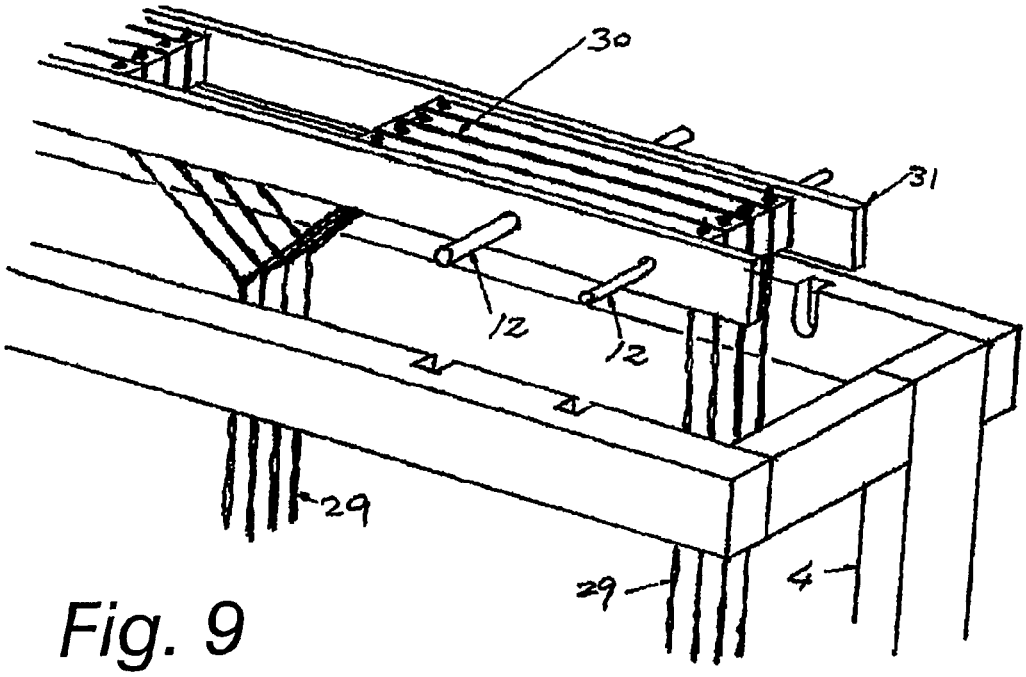
FIG. 9 shows a disengagement of a cassette 31 enclosing a set of the bars 30.
Figure 10:
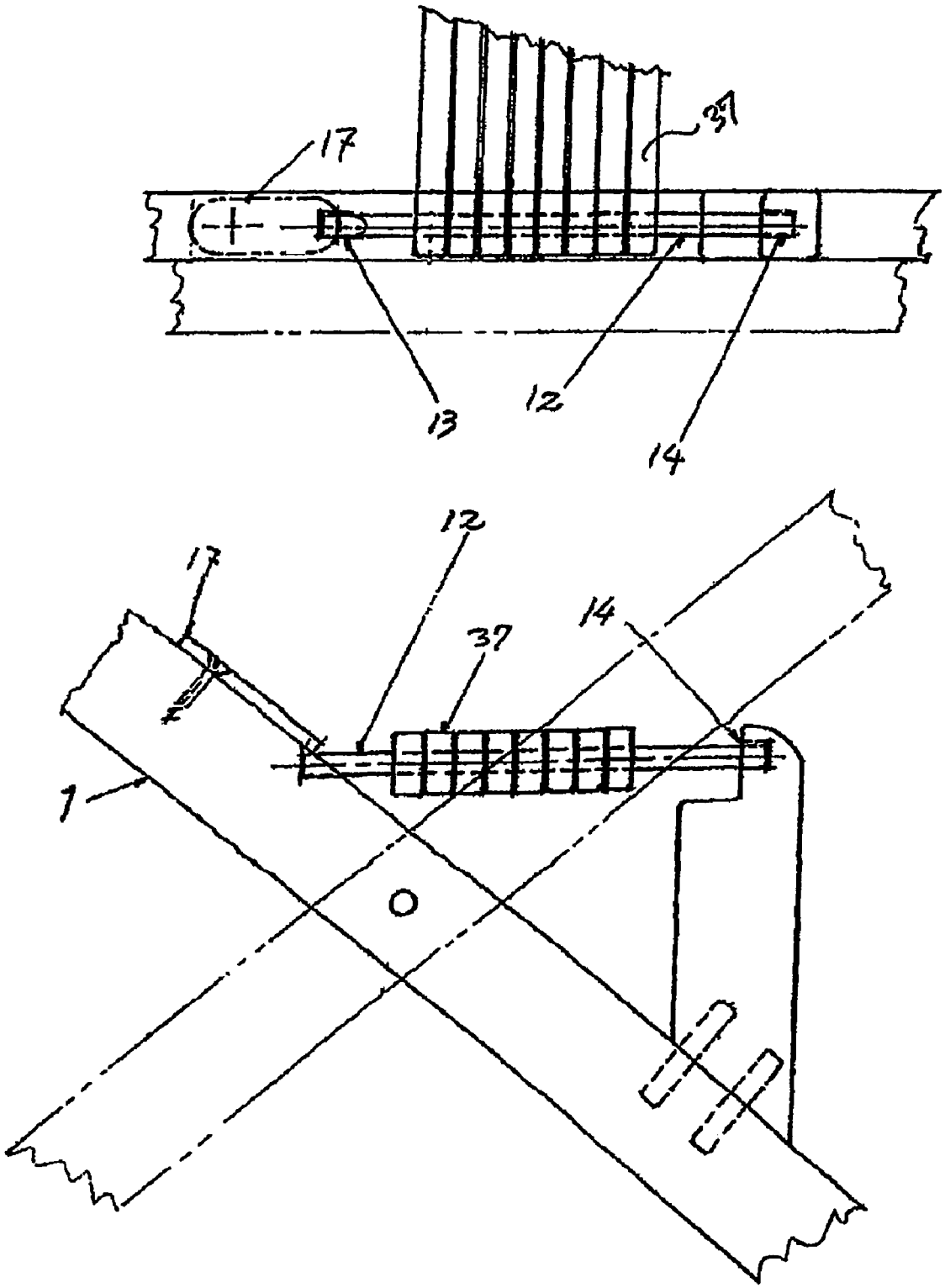
FIG. 10 shows a view of the removable transfer bars 37 in the vicinity of an axle.
Figure 12:
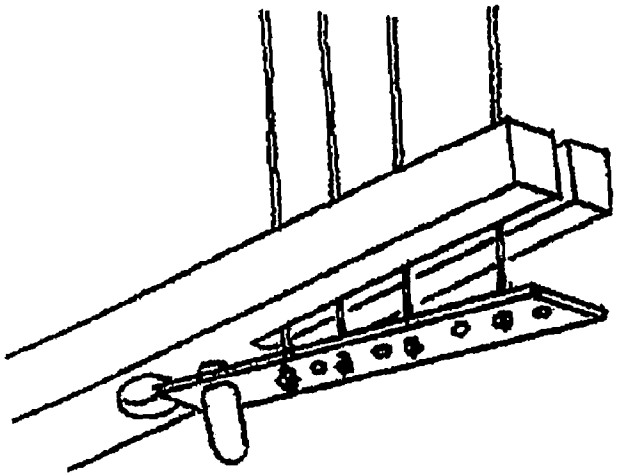
FIG. 12 shows an attachment of the cords of a transfer bar to a treadle by means of a strip 32.
Figure 11:
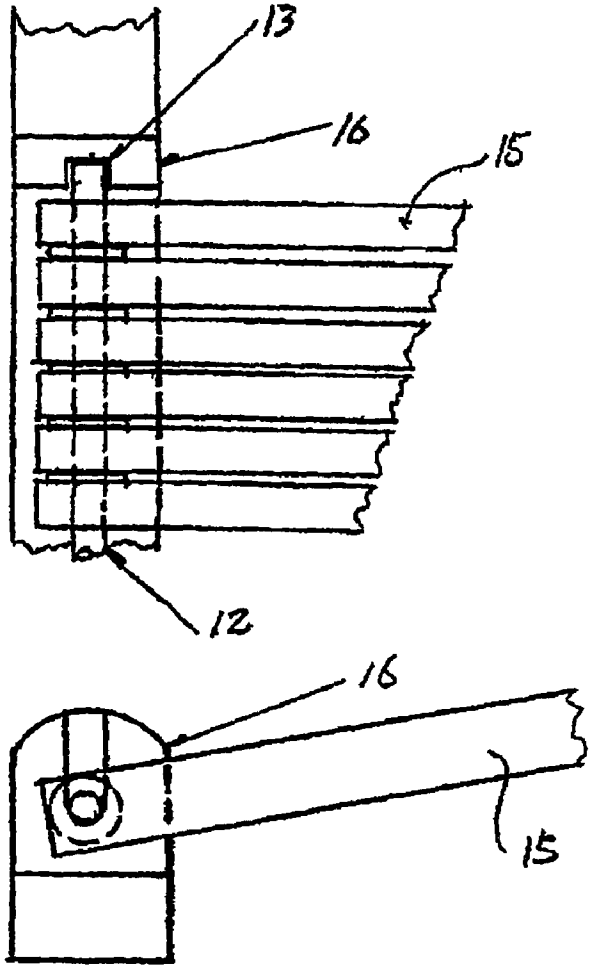
FIG. 11 shows a view of the removable treadles 15 in the vicinity of an axle.
Figure 13:
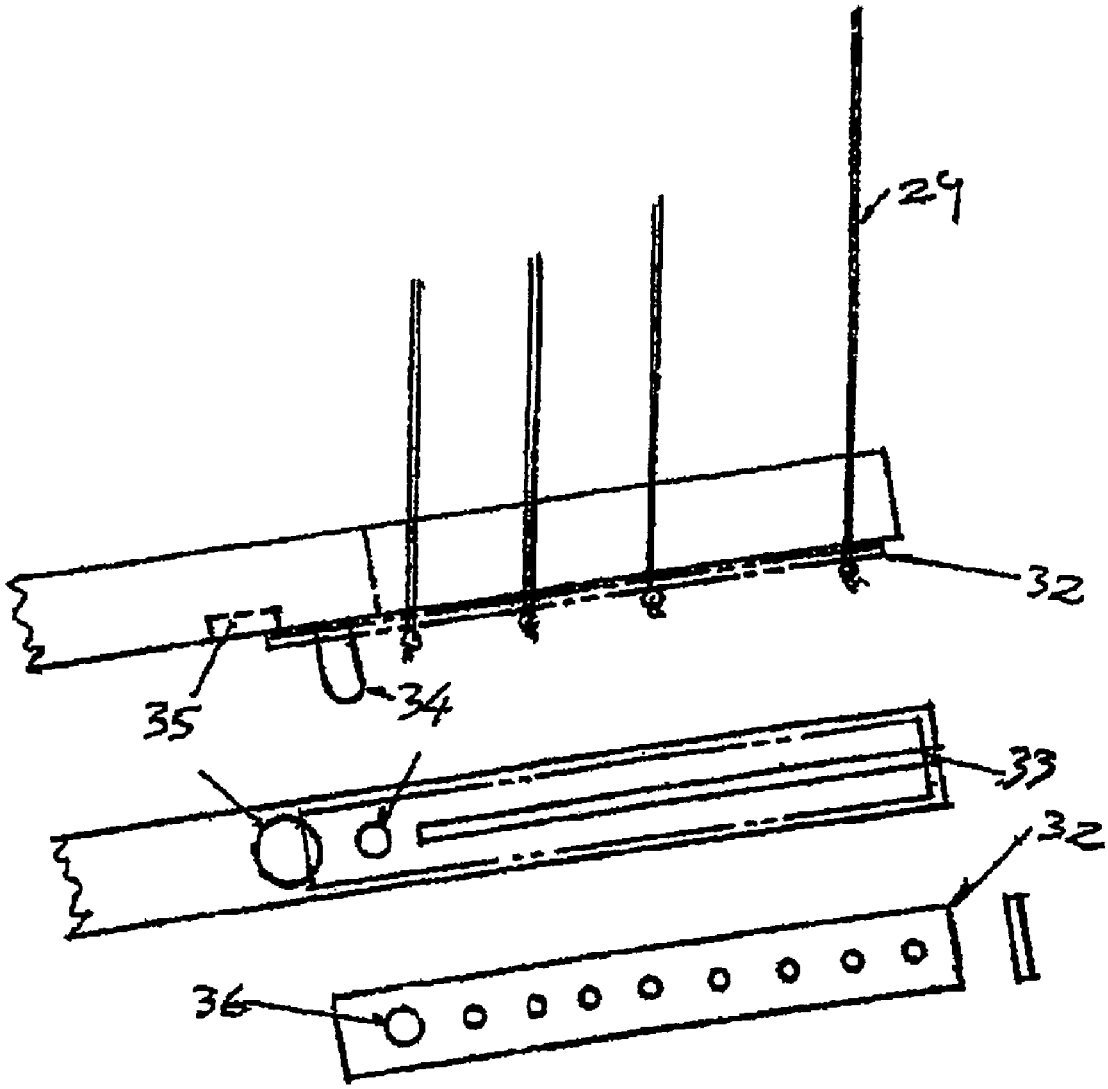
FIG. 13 shows a tying strip 32 for the cords of a transfer bar.
Figure 14:
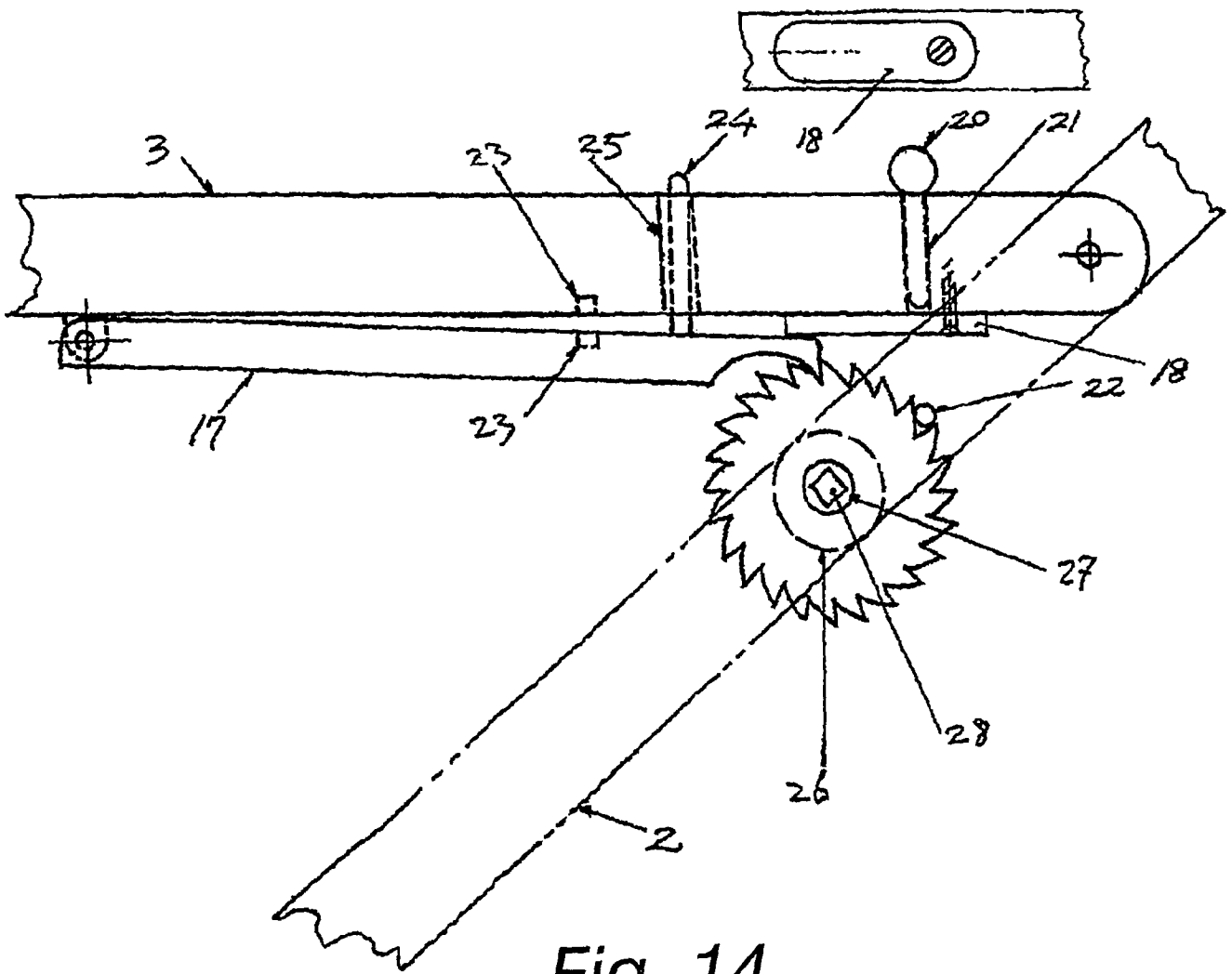
FIG. 14 shows a brake 17 for the warp beam 26.
Figure 15:
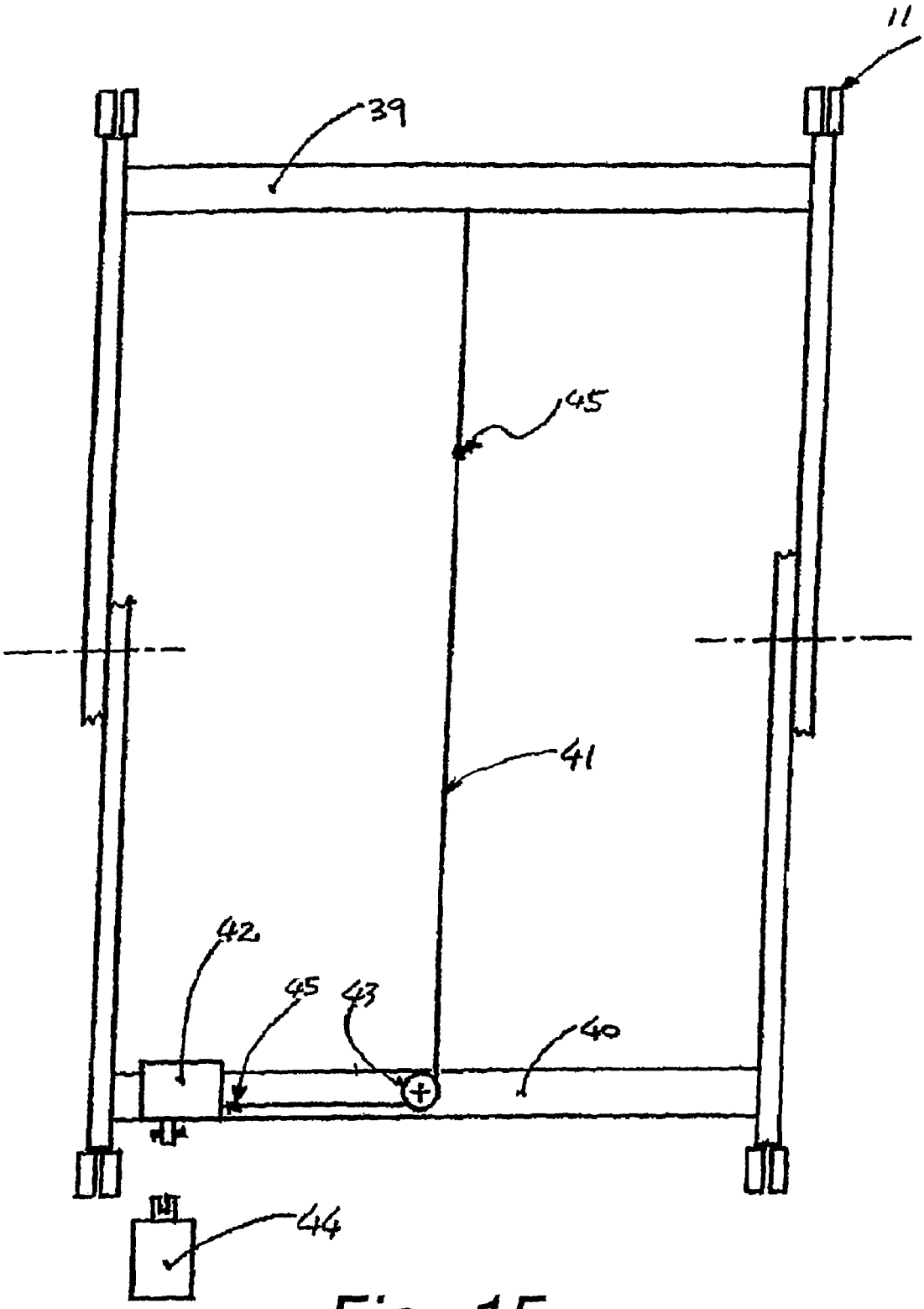
FIG. 15 shows a motor-driven mechanical 42 device for folding and unfolding.
Figure 16:
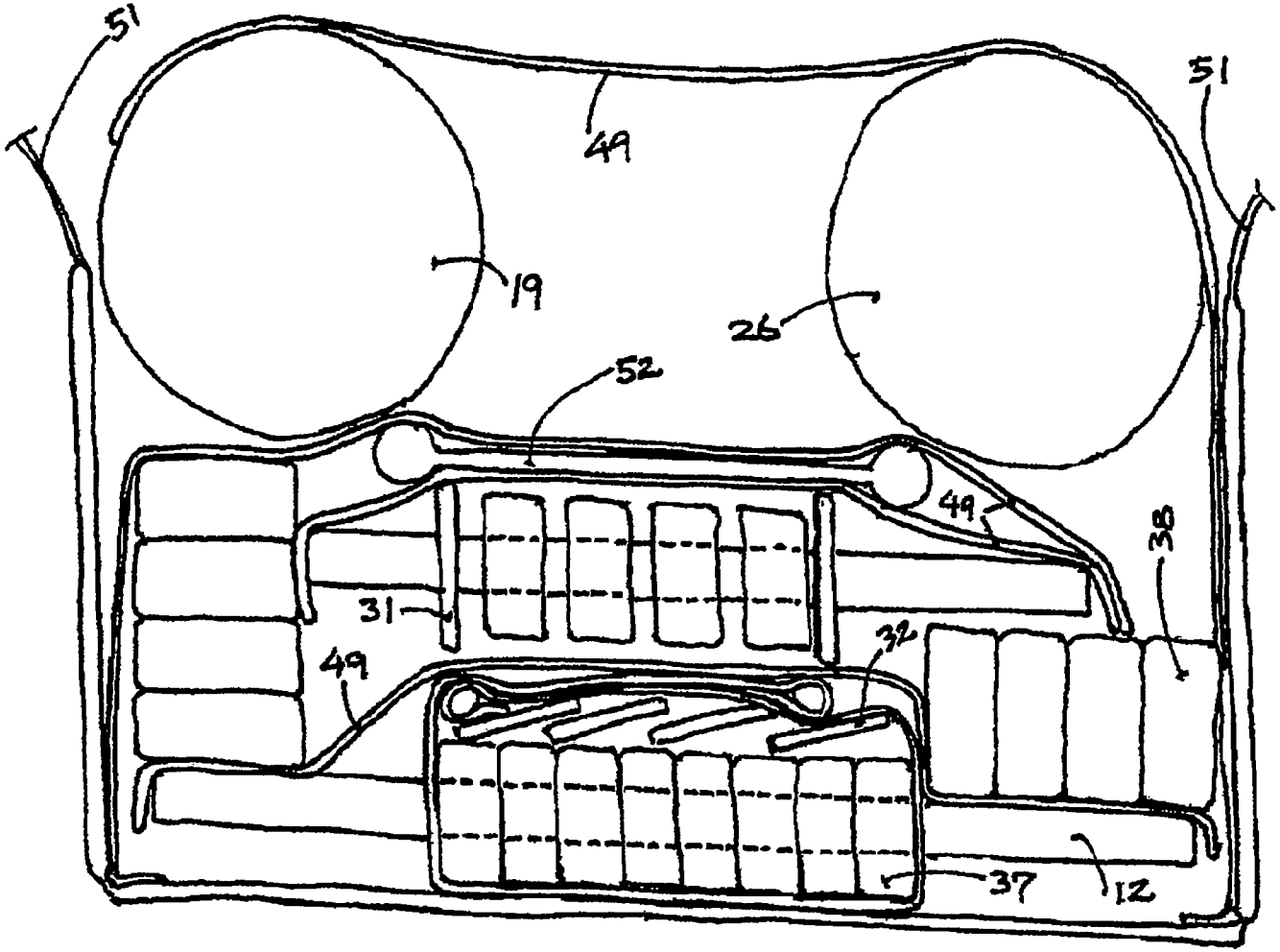
FIG. 16 shows a weaving assembly packing sequence.
Figure 17:
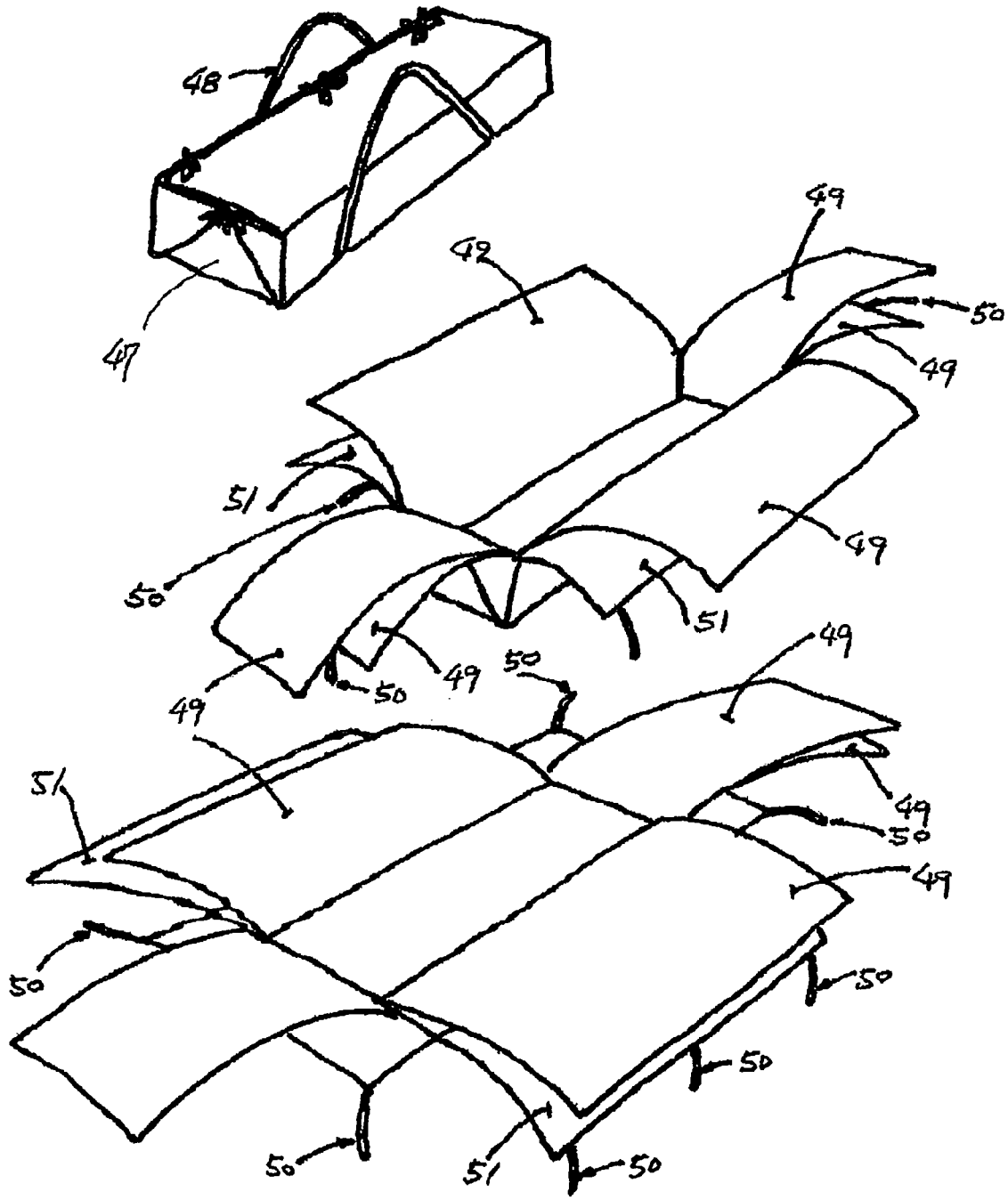
FIG. 17 shows a weaving assembly transport/storage case.
Figure 18:
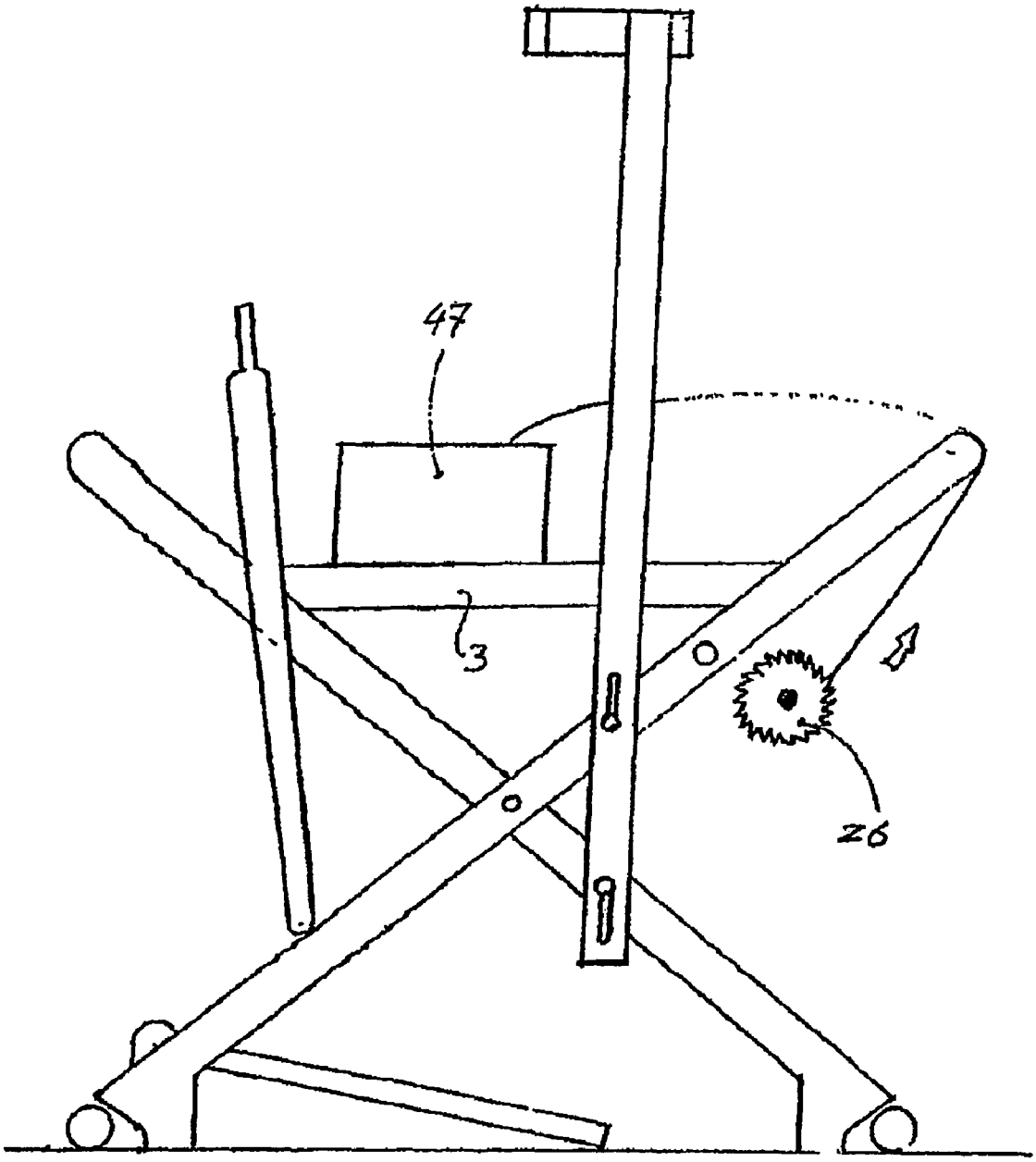
FIG. 18 shows a packing process, in which the warp beam 26 is last to be placed in a case 47.

1. Breast beam frame
2. Back beam frame
3. Horizontal support beam
4. Frame stanchion
5. Bar frame
6. Hole for locking studs
7. Locking stud for horizontal supports
8. Locking screws and wing nuts
9. Elongated holes for a bracket
10. Stabilizing foot
11. Wheel
12. Axles
13. Notches for axles
14. Blind holes for axles
15. Treadles
16. Treadle rack
17. Brake
18. Brake locking strip

19. Cloth beam
20. Locking stud
21. Locking stud storage
22. Locking stud hole
23. Magnet
24. Release stud
25. Stud guiding hole
26. Warp beam
27. Clamping shaft
28. Crank hole
29. Cords
30. Bars
31. Bar cassette
32. Fastening strips
33. Slot for cords
34. Strip retention stud
35. Finger notch
36. Hole for retention stud
37. Transfer bar
38. Harness shafts
39. Lower mid-beam, front
40. Lower mid-beam, back
41. Cable
42. Cable winder
43. Idler wheel
44. Removable motor
45. Cable marker
46. Knee lever
47. Storage and transport case
48. Case handle
49. Middle cloth
50. Tying ribbons
51. Cover cloth
52. Reed
53. Top slay beam The loom includes frames tied up for an X-conFIGuration. The breast beam frame 1 consists of a breast beam, two side sets, and a middle set. The back beam frame 2 consists of a back beam, two side sets, and a middle set. The breast beam frame is nested inside the back beam frame. The outer lateral dimension of the breast beam frame is equal to the inner lateral dimension of the back beam frame. The two frames are engaged by locking head screws and wing nuts 8 at a midpoint, establishing a symmetrical X-shape as seen from the side. The assembly is stabilized for a working condition by means of horizontal beams 3 extending between the side beams. The horizontal beams 3 have their first ends secured inside the back beam frame by means of the locking head screws and wing nuts 8. The horizontal beams 3 have their second ends beveled to an appropriate length and angle. The beveled ends rest upon the breast beam frame and the assembly is made sturdy by the clamping action of metal studs 7.

The bar frame's 5 stanchions 4 are secured to the frames by means of locking head screws and wing nuts 8 through an elongated hole 9. Between the leg and the side beam are provided intermediate pieces. The bar frame's 5 stanchions 4 are provided with two sets of elongated holes 9. The frame is limited to a given X-shape by the length of and the distance between the holes, defining a trajectory of the frames in such a way that the unfolding proceeds to a proper position. The cloth beam 19 is set between the breast beam frame's diagonal pieces (called legs).

The beam carries a removable ratchet wheel at one end. The axle present at the ratchet wheel end is placed in a hole present in the leg and the axle at the other end is dropped into a notch present in the leg. In a disengagement process, the axle is first lifted from the notch and the other axle is pulled out of the hole. The warp beam 26 is set in another frame. And, the installation and removal are carried out by the same method.

Folding down the loom, with a cloth and warps in place, proceeds as follows: First, the wing nuts are loosened, followed by loosening the cloth and the warp to a suitable degree, as well as by locking the warp beam with a stud. This is followed by disengaging the knee lever, which is moved to a position assigned for it below the transfer bars. Then, the horizontal beams 3 are lifted to an upright position and the slay is fixed to the breast beam. After this, the motor power is applied for drawing the loom to a folded condition. In the folded condition, the wheels will be in an upright position and the loom can be set aside. The loom unfolding process occurs in a reverse order.

In a totally unfolded condition, the loom stands firmly on a base stabilized by supports at the legs' bottom ends.

The invention claimed is:

1. A collapsible loom, comprising a folding loom, comprising first and second side beams (1, 2) secured in an X-configuration to form frames of the loom; and a horizontal beam (3) having a first end and a second end;

wherein said first end of said horizontal beam fixedly engages said first side beam; and wherein said second end of said horizontal beam is rotatably attached to said second side beam;

a removable weaving assembly, including a warp beam (26) with its warps, a warp beam ratchet wheel, harness shafts (38), a reed (52), and a cloth beam (19) with its cloth, wherein the removable weaving assembly, which is detachable and transferable to another loom, further includes bars (30) confined in a bar cassette (31), transfer bars (37), tying members (32) for treadles (15), and a number of harness shafts (38) actuated by the treadles (15).

2. A collapsible loom as set forth in claim 1, further comprising a motorized screw (42) for folding the loom without dismounting the cloth, and wheels on which the folded loom can be rolled for storage.

3. A collapsible loom as set forth in claim 1 wherein, when set up in a working condition, the loom is locked to a sturdy unit resting on supporting feet (10).

4. A collapsible loom as set forth in claim 1, having a locking feature present therein for the warp beam's (26) ratchet wheel, wherein said locking feature is provided by means of a lever (17), and that to facilitate the locking and unlocking, there is a magnet (23) and a release stud (24), included in the lever (17).

5. A collapsible loom as set forth in claim 1, wherein said first end of said horizontal beam fixedly engages said first side beam by means of a locking stud (7).

6. A collapsible loom as set forth in claim 1, wherein said first end of said horizontal beam is beveled, such that said beveled end rest on said first side beam.

* * * * *